US010816925B1

(12) United States Patent
Akiyama

(10) Patent No.: US 10,816,925 B1
(45) Date of Patent: Oct. 27, 2020

(54) IMAGE FORMING APPARATUS HAVING CONTROLLER TO CONTROL STABILIZATION PROCESS DEPENDING ON TONER AMOUNT

(71) Applicant: TOSHIBA TEC KABUSHIKI KAISHA, Tokyo (JP)

(72) Inventor: Yuuichi Akiyama, Numazu Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/567,784

(22) Filed: Sep. 11, 2019

(51) Int. Cl.
*G03G 15/08* (2006.01)
*G03G 15/00* (2006.01)

(52) U.S. Cl.
CPC ..... *G03G 15/5058* (2013.01); *G03G 15/0856* (2013.01); *G03G 2215/00059* (2013.01)

(58) Field of Classification Search
CPC ..... G03G 15/5041; G03G 15/0856; G03G 15/0858; G03G 15/086; G03G 15/0862; G03G 15/5058; G03G 15/556; G03G 2215/00029; G03G 2215/00037; G03G 2215/00042; G03G 2215/00059
USPC ..... 399/27, 49, 61
See application file for complete search history.

(56) References Cited

U.S. PATENT DOCUMENTS

2008/0131150 A1* 6/2008 Tomita ..... G03G 15/0131 399/49
2011/0143272 A1* 6/2011 Urasawa ..... G03G 15/065 430/30

FOREIGN PATENT DOCUMENTS

| | | | |
|---|---|---|---|
| JP | H10-207319 A | | 8/1998 |
| JP | 2000284563 A | * | 10/2000 |
| JP | 2006235009 A | * | 9/2006 |
| JP | 2007052297 A | * | 3/2007 |
| JP | 2008158373 A | * | 7/2008 |
| JP | 2009025626 A | * | 2/2009 |

* cited by examiner

*Primary Examiner* — Robert B Beatty
(74) *Attorney, Agent, or Firm* — Kim & Stewart LLP

(57) ABSTRACT

An image forming apparatus includes a photosensitive drum, a developing device, a transfer unit, an image sensor configured to detect a toner image on the transfer unit, and a processor. The processor is configured to determine whether the remaining amount of toner in a toner cartridge has decreased to a predetermined level or below. The processor is configured to carry out an image quality stabilization process when the remaining amount of toner is above the predetermined level. The image quality stabilization process being based on a detection result from the image sensor detecting a test pattern formed on the transfer unit. The processor is further configured to perform print process without performing an image stabilization process, without carrying out the image quality stabilization process.

14 Claims, 5 Drawing Sheets

IMAGE FORMING APPARATUS HAVING CONTROLLER TO CONTROL STABILIZATION PROCESS DEPENDING ON TONER AMOUNT

FIELD

Embodiments described herein relate generally to an image forming apparatus and a control method of an image forming apparatus.

BACKGROUND

An image forming apparatus performs an image forming process of receiving toner from a toner cartridge and forms a toner image on a photosensitive drum. The image forming apparatus transfers the toner image from the photosensitive drum to a printing medium, such as a sheet of paper or the like.

The image forming apparatus calculates an amount of toner supplied to the image forming apparatus from the toner cartridge (also referred to as an amount of delivered toner) based on how long a toner supply motor is driven (for example, the length of time the motor is driven). The motor is used for rotating a screw or auger delivering toner to the image forming apparatus from the toner cartridge. The amount of toner can also or instead be calculated based an image density (or the number of pixels) of a printed page or the like. The image forming apparatus determines whether the remaining amount of toner in the toner cartridge is low (for example, the toner is in a near empty state) based on the amount of delivered toner and a storage capacity of the toner cartridge. If the toner cartridge is in a near empty state, the image forming apparatus outputs a notification (e.g., a toner near empty display) suggesting preparation for replacement of the toner cartridge.

To maintain image quality, the image forming apparatus performs an image quality stabilization process including forming a test pattern using toner, detecting the formed test pattern with a sensor, and controlling a parameter of the image forming process based on the result of detection. Such an image quality stabilization process consumes toner, and may shorten the time between the output of the toner near empty notification and the toner empty state.

DETAILED DESCRIPTION

In general, according to an embodiment, an image forming apparatus includes a photosensitive drum, a developing device configured to supply toner from a toner cartridge to a surface of the photosensitive drum to form a toner image, a transfer unit configured to receive the toner image from the photosensitive drum, an image sensor configured to detect the toner image on the transfer unit, and a processor. The processor is configured to: determine whether a remaining amount of toner in the toner cartridge is at or below a predetermined level; when the remaining amount of toner is above the predetermined level, perform an image quality stabilization process based on a detection result from the image sensor detecting a test pattern on the transfer unit; and when the remaining amount of toner is at or below the predetermined level, perform print processing without performing an image quality stabilization process.

Hereinafter, an image forming apparatus and a control method of the image forming apparatus according to one embodiment will be described with reference to the accompanying drawings.

Figure 1:
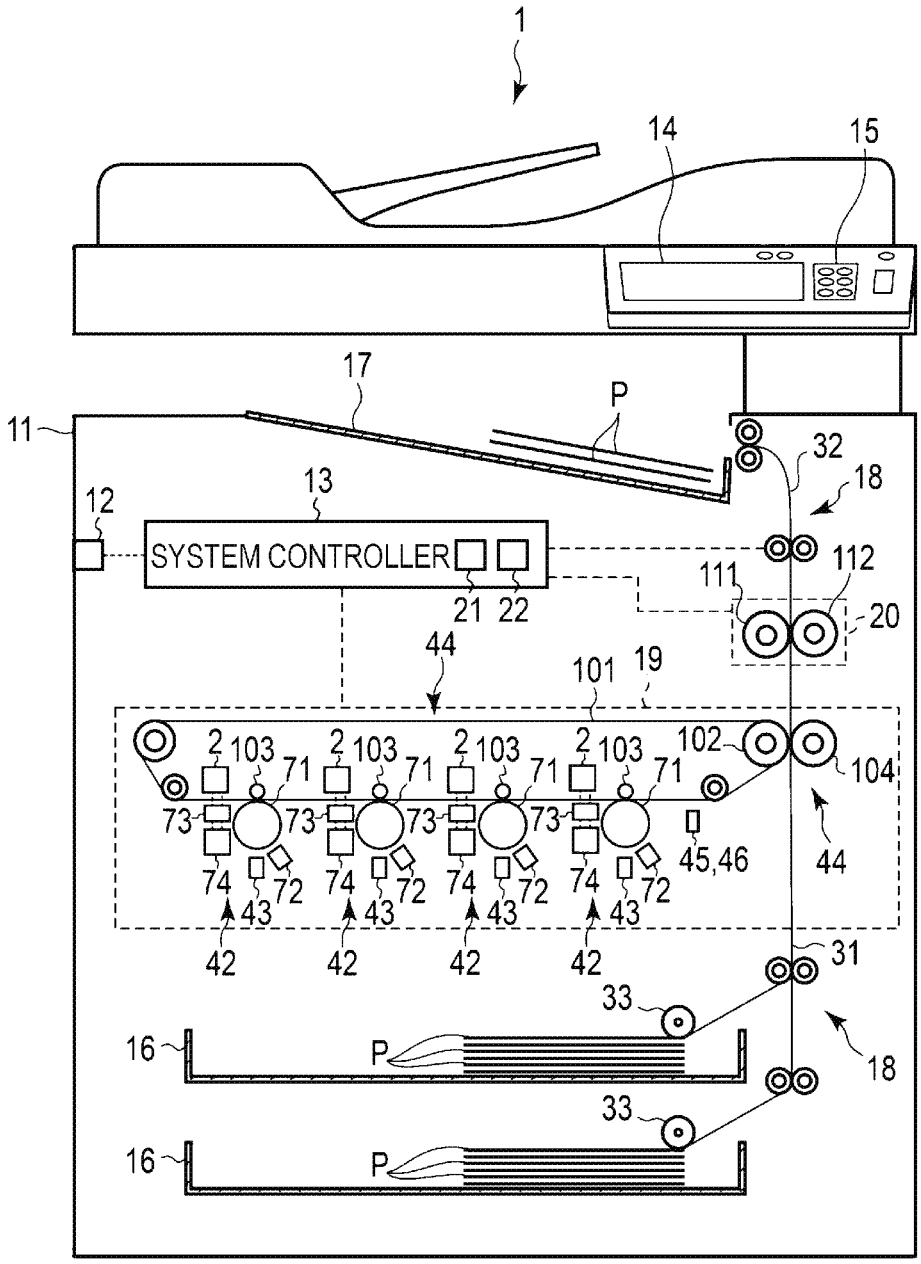
FIG. 1 illustrates an example of a configuration of an image forming apparatus according to a first embodiment.

FIG. 1 illustrates an example of a configuration of an image forming apparatus 1 according to one embodiment.

The image forming apparatus 1 is, for example, a multifunction printer (MFP) which performs various processes such as forming an image, while conveying a recording medium such as a printing medium. The image forming apparatus 1 is, for example, a solid-state scanning type printer (for example, an LED printer) which scans an LED array for forming an image while conveying a recording medium.

For example, the image forming apparatus 1 includes a configuration to receive toner from a toner cartridge 2 and to form an image on a printing medium using the received toner. The toner may be monochrome toner or may be color toner of color such as cyan, magenta, yellow, or black.

As shown in FIG. 1, the image forming apparatus 1 includes a housing 11, a communication interface 12, a system controller 13, a display unit 14, an operation interface 15, a plurality of paper trays 16, a paper discharge tray 17, a conveyance unit 18, an image forming unit 19, and a fixing device 20.

The housing 11 is a main body of the image forming apparatus 1. The housing 11 accommodates the communication interface 12, the system controller 13, the display unit 14, the operation interface 15, the plurality of paper trays 16, the paper discharge tray 17, the conveyance unit 18, the image forming unit 19, and the fixing device 20.

The communication interface 12 is an interface for communicating with another device. For example, the communication interface 12 is used for communicating with a print server, print controller, or other external device. The communication interface 12 is configured as a LAN connector, for example. The communication interface 12 may also be an interface which communicates with another device wirelessly according to standards such as Bluetooth® or The system controller 13 controls the image forming apparatus 1. The system controller 13 includes, for example, a processor 21 and a memory 22.

The processor 21 is an arithmetic element for executing an arithmetic process. The processor 21 is, for example, a CPU. The processor 21 performs various processes based on data of a program or the like stored in the memory 22. The processor 21 functions as a controller capable of executing various acts by executing a program stored in the memory 22.

The memory 22 is a storage medium which stores a program and data used in the program. The memory 22 also functions as a working memory. That is, the memory 22 temporarily stores data which is being processed by the processor 21, and a program which is executed by the processor 21.

The processor 21 performs various information processes by executing a program stored in the memory 22. For example, the processor 21 generates a printing job based on image data obtained from an external device via the communication interface 12. The processor 21 stores the generated printing job in the memory 22.

The printing job includes image data of an image to be formed on a printing medium P. The image data may be data for forming an image on a single sheet of printing medium P or multiple sheets of printing media P. Furthermore, the printing job includes information indicating whether printing is to be a color printing or a monochrome printing.

The processor 21 functions as a controller for controlling operations of the conveyance unit 18, the image forming unit 19, and the fixing device 20 by executing a program stored in the memory 22. The processor 21 may be referred to as a print engine controller in some contexts. That is, the processor 21 controls conveyance of the printing medium P by the conveyance unit 18, controls forming of an image on the printing medium P by the image forming unit 19, and controls fixing of the image onto the printing medium P by the fixing device 20.

The image forming apparatus 1 may be such that the print engine controller is separate from the system controller 13. In this case, the print engine controller controls conveyance of the printing medium P by the conveyance unit 18, controls forming of the image on the printing medium P by the image forming unit 19, and controls fixing of the image onto the printing medium P by the fixing device 20 and the system controller 13 supplies information necessary for controlling by the print engine controller to the print engine controller.

The display unit 14 includes a display which displays an image according to an image signal from the system controller 13 or a display controller, such as a graphics controller. For example, a screen for various settings of the image forming apparatus 1 is displayed on the display of the display unit 14.

The operation interface 15 is connected to a user input unit or device. The operation interface 15 supplies an input signal corresponding to an operation of input unit/device to the system controller 13. The input unit/device is, for example, a touch sensor, a numeric keypad, a power button, a paper feed button, various function keys or buttons, a keyboard, or the like. The touch sensor obtains information indicating a user selection position or the like. The touch sensor can be configured as a touch panel integrated into the display unit 14, thereby generating a signal indicating a touched position on a user interface screen displayed on the display unit 14 to the system controller 13.

The paper trays 16 are cassettes which accommodate printing media P. The paper tray 16 is configured to supply the printing medium P from the outside of the housing 11. For example, the paper tray 16 is configured to be removable from the housing 11.

The paper discharge tray 17 is a tray which supports a printing medium P after discharge from the image forming apparatus 1.

Hereinafter, a configuration of the image forming apparatus 1 for conveying the printing medium P will be described.

The conveyance unit 18 is a mechanism for conveying the printing medium P in the image forming apparatus 1. As shown in FIG. 1, the conveyance unit 18 includes a plurality of conveyance paths. As depicted, the conveyance unit 18 includes a paper feed conveyance path 31 and a paper discharge conveyance path 32.

Each of the paper feed conveyance path 31 and the paper discharge conveyance path 32 is formed by a plurality of motors, a plurality of rollers, and a plurality of guides. The plurality of motors rotate rollers coupled to a shaft based on control from the system controller 13. The plurality of rollers move the printing medium P. The plurality of guides control a conveyance direction of the printing medium P.

The paper feed conveyance path 31 picks up the printing medium P from the paper tray 16 and supplies the printing medium P to the image forming unit 19. The paper feed conveyance path 31 includes pickup rollers 33 corresponding to the respective paper trays 16. Each pickup roller 33 picks up the printing medium P of a corresponding paper tray 16 for the paper feed conveyance path 31.

The paper discharge conveyance path 32 is a conveyance path which discharges the printing medium P from the housing 11 after an image has been formed. The printing medium P discharged by the paper discharge conveyance path 32 is supported by the paper discharge tray 17.

Hereinafter, the image forming unit 19 will be described.

The image forming unit 19 forms an image on the printing medium P. Specifically, the image forming unit 19 forms an image on the printing medium P based on a printing job generated by the processor 21.

The image forming unit 19 includes a plurality of toner loading units 41, a plurality of toner processing units 42, a plurality of light exposure devices 43, a toner transfer mechanism 44, a plurality of first image sensors 45, and a second image sensor 46. The image forming unit 19 includes a toner loading unit 41 and a light exposure device 43 for each toner processing unit 42. Since each of the toner processing units 42, the toner loading units 41, and light exposure devices 43 have the same configuration, respectively, only one toner processing unit 42, one toner loading unit 41, and one light exposure device 43 will be described.

Figure 2:
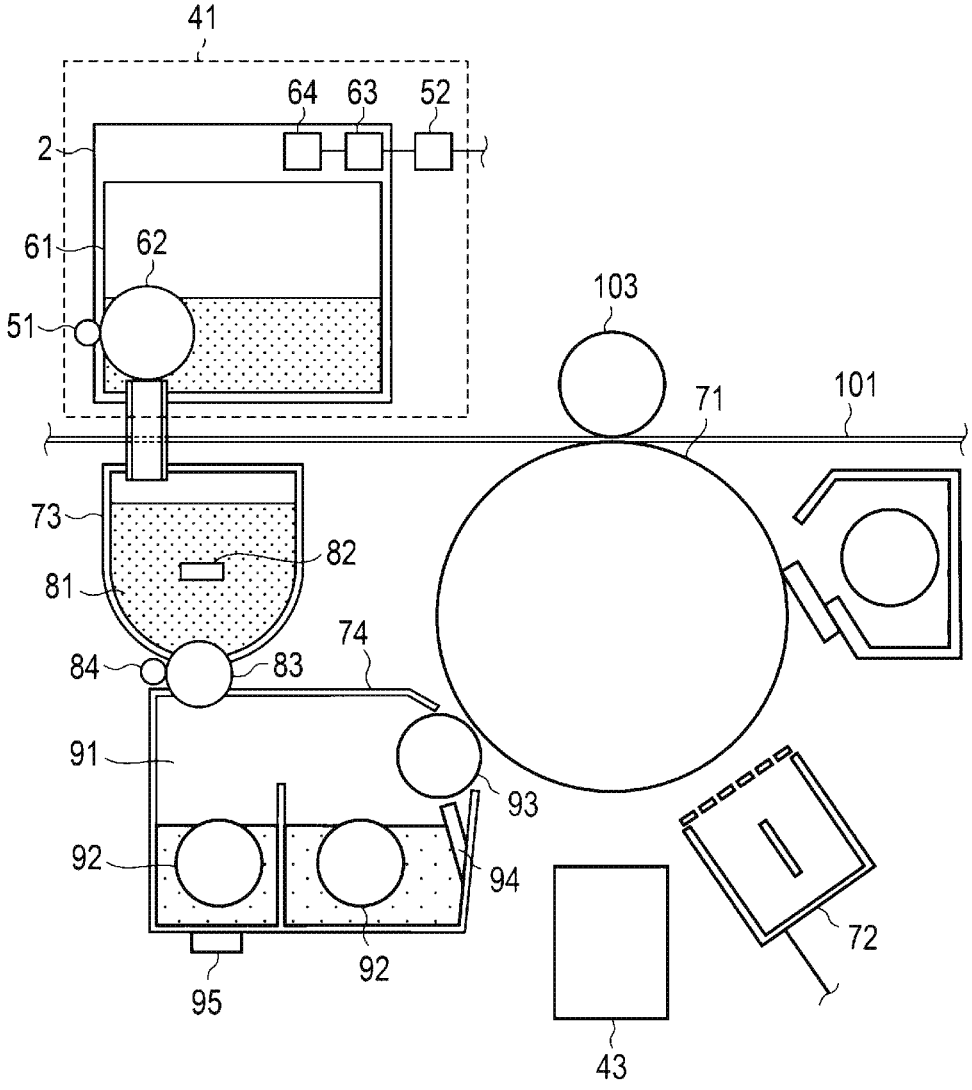
FIG. 2 illustrates an example of a configuration of a part of an image forming unit according to the first embodiment.

FIG. 2 is an explanatory view illustrating an example of a configuration of a part of the image forming unit 19.

First, the toner loading unit 41 in which the toner cartridge 2 is mounted will be described.

As shown in FIG. 2, the toner loading unit 41 is a module in which a toner cartridge 2 is mounted. Each of the toner loading units 41 includes a space in which a toner cartridge 2 can be mounted, a first toner supply motor 51, and a communication interface 52 for the mounted toner cartridge 2.

The first toner supply motor 51 drives a toner delivery mechanism of the toner cartridge 2, which will be further described below, based on control of the processor 21. When the toner cartridge 2 is loaded into the toner loading unit 41, the first toner supply motor 51 is connected with the toner delivery mechanism of the toner cartridge 2.

The communication interface 52 communicates with the toner cartridge 2. When the toner cartridge 2 is loaded into the toner loading unit 41, the communication interface 52 is connected with a communication interface in the toner cartridge 2.

Hereinafter, the toner cartridge 2 will be described.

As shown in FIG. 2, the toner cartridge 2 includes a toner container 61, a toner delivery mechanism 62, a communication interface 63, and an IC chip 64.

The toner container 61 is a container accommodating a toner.

The toner delivery mechanism 62 transports the toner from the toner container 61. The toner delivery mechanism 62 is, for example, a screw that is installed inside the toner container 61, and delivers the toner by rotating. The toner delivery mechanism 62 is driven by the first toner supply motor 51. In some examples, the toner cartridge 2 may itself be configured to include the motor for rotating the toner delivery mechanism 62.

The communication interface 63 is an interface for communicating with the image forming apparatus 1. When the toner cartridge 2 is mounted in the toner loading unit 41, the communication interface 63 is connected with the communication interface 52.

The IC chip 64 includes a memory, which stores various control parameters in advance, and a processor. The control parameters are, for example, an identification code, a near empty threshold value, or the like. The identification code indicates a kind, a model number, or the like of the toner cartridge 2. The near empty threshold value is a threshold value permitting the image forming apparatus 1 to determine whether the amount of toner remaining in the toner cartridge 2 is to be considered low.

Hereinafter, the processing unit 42 will be described.

The processing unit 42 has a configuration for forming a toner image. For example, processing units 42 are provided for each kind of toner available in the image forming apparatus 1. For example, the processing units 42 respectively correspond to color toners of cyan, magenta, yellow, and black. Generally, a toner cartridge 2 having a toner of a different color is connected to each of the different processing units 42.

As shown in FIG. 2, the processing unit 42 includes a photosensitive drum 71, a charger 72, a sub tank 73, and a developing device 74.

The photosensitive drum 71 is a photosensitive body formed of a cylindrical drum and a photosensitive layer formed on the outer circumferential surface of the drum. The photosensitive drum 71 rotates at a constant speed by a driving mechanism.

The electrostatic charger 72 uniformly charges a surface of the photosensitive drum 71. For example, the charger 72 charges the photosensitive drum 71 to have a uniform negative polarity potential (contrast potential) by applying a developing bias voltage to the photosensitive drum 71 by using a charging roller. The charging roller is rotated by rotation of the photosensitive drum 71 at a predetermined pressure applied to the photosensitive drum 71. The contrast potential changes according to the strength of the developing bias voltage. That is, the developing bias voltage and the contrast potential may be considered as related to an intensity of the electrostatic charging of the photosensitive drum 71.

The sub tank 73 receives the toner from the toner cartridge 2, and accommodates the received toner. The sub tank 73 supplies the toner to the developing device 74. The sub tank 73 includes a toner container 81, a toner residue sensor 82, a toner delivery mechanism 83, and a second toner supply motor 84.

The toner container 81 is a container accommodating the toner received from the toner cartridge 2.

The toner residue sensor 82 is a sensor that detects an amount of toner remaining in the toner container 81. The toner residue sensor 82 is in the toner container 81. The toner residue sensor 82 is a sensor that detects whether the toner is present at an installation position thereof. The toner residue sensor 82 is configured by, for example, a piezoelectric sensor, a transmitted light sensor, a reflected light sensor, or the like.

If toner is at a detection position, the toner residue sensor 82 outputs a signal indicating an ON state. If the toner is not at the detection position, the toner residue sensor 82 makes the output the signal to indicate an OFF state. In this example, the toner residue sensor 82 detects the presence or absence of the toner at a predetermined height within the toner container 81.

The toner delivery mechanism 83 delivers the toner in the toner container 81 to the developing device 74. The toner delivery mechanism 83 is, for example, a screw that is installed in the toner container 81, and delivers the toner by rotating. The toner delivery mechanism 83 is driven by the second toner supply motor 84.

The second toner supply motor 84 drives the toner delivery mechanism 83 based on control of the processor 21. The second toner supply motor 84 supplies the toner in the toner container 81 to the developing device 74 by driving the toner delivery mechanism 83.

The developing device 74 attaches the toner to the photosensitive drum 71. The developing device 74 includes a developer container 91, an agitation mechanism 92, a developing roller 93, a doctor blade 94, and an auto toner control (ATC) sensor 95.

The developer container 91 accommodates a developer including toner and a carrier. The developer container 91 receives the toner delivered from the toner container 81 of the sub tank 73 by the toner delivery mechanism 83 of the sub tank 73. The carrier is accommodated in the developer container 91 when the developing device 74 is initially manufactured or installed.

The agitation mechanism 92 is driven by a motor and agitates the toner and the carrier in the developer container 91.

The developing roller 93 attaches the developer to a surface by rotating in the developer container 91.

The doctor blade 94 is a member that is disposed at a predetermined interval from the surface of the developing roller 93. The doctor blade 94 removes apart of the developer attached to the surface of the rotating developing roller 93. Accordingly, a developer layer having a thickness corresponding to the interval between the doctor blade 94 and the surface of the developing roller 93 is formed on the surface of the developing roller 93.

The ATC sensor 95 is, for example, a magnetic flux sensor that includes a coil and detects a voltage value generated in the coil. The detected voltage of the ATC sensor 95 changes according to a density of magnetic flux from the toner in the developer container 91. That is, the system controller 13 may determine a concentration ratio of the remaining toner in the developer container 91 to the carrier based on the detected voltage of the ATC sensor 95.

Hereinafter, the light exposure device 43 will be described.

The light exposure device 43 includes a plurality of light emitters. The light exposure device 43 forms a latent image on the photosensitive drum 71 by emitting light to the charged photosensitive drum 71 from the light emitters. The light emitter is, for example, a light emitting diode (LED) or the like. One light emitter is configured to emit light to one point on the photosensitive drum 71. The plurality of light emitters are arranged in a main scanning direction which is a direction parallel to the rotary shaft of the photosensitive drum 71.

The light exposure device 43 forms a latent image for one scan line on the photosensitive drum 71 using the plurality of light emitters arranged along the main scanning direction. Furthermore, the light exposure device 43 forms complete latent images by emitting light while the photosensitive drum 71 rotates (in the sub-scanning direction).

In the above-described configuration, when light is emitted from the light exposure device 43 to the surface of the photosensitive drum 71 charged by the charger 72, an electrostatic latent image is formed. When the developer layer formed on the surface of the developing roller 93 approaches the surface of the photosensitive drum 71, the toner included in the developer is attached to the latent image formed on the surface of the photosensitive drum 71. As a result, a toner image is formed on the surface of the photosensitive drum 71.

Hereinafter, the transfer mechanism 44 will be described.

The transfer mechanism 44 transfers the toner image formed on the surface of the photosensitive drum 71 to the printing medium P.

As shown in FIGS. 1 and 2, the transfer mechanism 44 includes, for example, a primary transfer belt 101, a plurality of primary transfer rollers 103, a secondary transfer opposite roller 102, and a secondary transfer roller 104.

The primary transfer belt 101 is an endless belt which is looped around the secondary transfer opposite roller 102 and a plurality of winding rollers. The primary transfer belt 101 has an inner surface (inner circumferential surface) in contact with the secondary transfer opposite roller 102 and the plurality of winding rollers, and an outer surface (outer circumferential surface) facing the photosensitive drum 71 of the processing unit 42.

The secondary transfer opposite roller 102 rotates by a motor. The secondary transfer opposite roller 102 conveys the primary transfer belt 101 in a predetermined conveyance direction by rotating. The plurality of winding rollers are freely rotatable. The winding rollers rotate according to movement of the primary transfer belt 101 as caused by the secondary transfer opposite roller 102.

The primary transfer rollers 103 are configured to bring the primary transfer belt 101 into contact with the photosensitive drums 71 of the processing units 42. The primary transfer rollers 103 are provided to correspond to the photosensitive drums 71 of the processing units 42. Specifically, each of the primary transfer rollers 103 is provided at a position opposite to a photosensitive drum 71 of one of the processing units 42 corresponding thereto with the primary transfer belt 101 being sandwiched therebetween. The primary transfer roller 103 is in contact with the inner circumferential surface of the primary transfer belt 101, and displaces the primary transfer belt 101 toward the photosensitive drum 71. Accordingly, the primary transfer roller 103 brings the outer circumferential surface of the primary transfer belt 101 into contact with the photosensitive drum 71.

The secondary transfer roller 104 is provided at a position opposite to the primary transfer belt 101. The secondary transfer roller 104 is in contact with the outer circumferential surface of the primary transfer belt 101 and applies a pressure to the outer circumferential surface. Accordingly, a transfer nip where the secondary transfer roller 104 and the outer circumferential surface of the primary transfer belt 101 are in close contact with each other is formed. When the printing medium P passes through the transfer nip, the secondary transfer roller 104 presses the printing medium P passing through the transfer nip against the outer circumferential surface of the primary transfer belt 101.

The secondary transfer roller 104 and the secondary transfer opposite roller 102 convey the printing medium P supplied from the paper feed conveyance path 31 by rotating, in a state of being sandwiched therebetween. Accordingly, the printing medium P passes through the transfer nip.

In the above-described configuration, when the outer circumferential surface of the primary transfer belt 101 comes into contact with the photosensitive drum 71, the toner image formed on the surface of the photosensitive drum is transferred to the outer circumferential surface of the primary transfer belt 101. As shown in FIG. 1, if the image forming unit 19 includes the plurality of processing units 42, the primary transfer belt 101 receives toner images from the photosensitive drums 71 of the plurality of processing units 42. The toner image transferred to the outer circumferential surface of the primary transfer belt 101 is conveyed to the transfer nip where the secondary transfer roller 104 and the outer circumferential surface of the primary transfer belt 101 are in close contact with each other, by the primary transfer belt 101. If the printing medium P exists at the transfer nip, the toner image transferred to the outer circumferential surface of the primary transfer belt 101 is transferred to the printing medium P at the transfer nip.

Hereinafter, the first image sensor 45 and the second image sensor 46 will be described.

Figure 3:
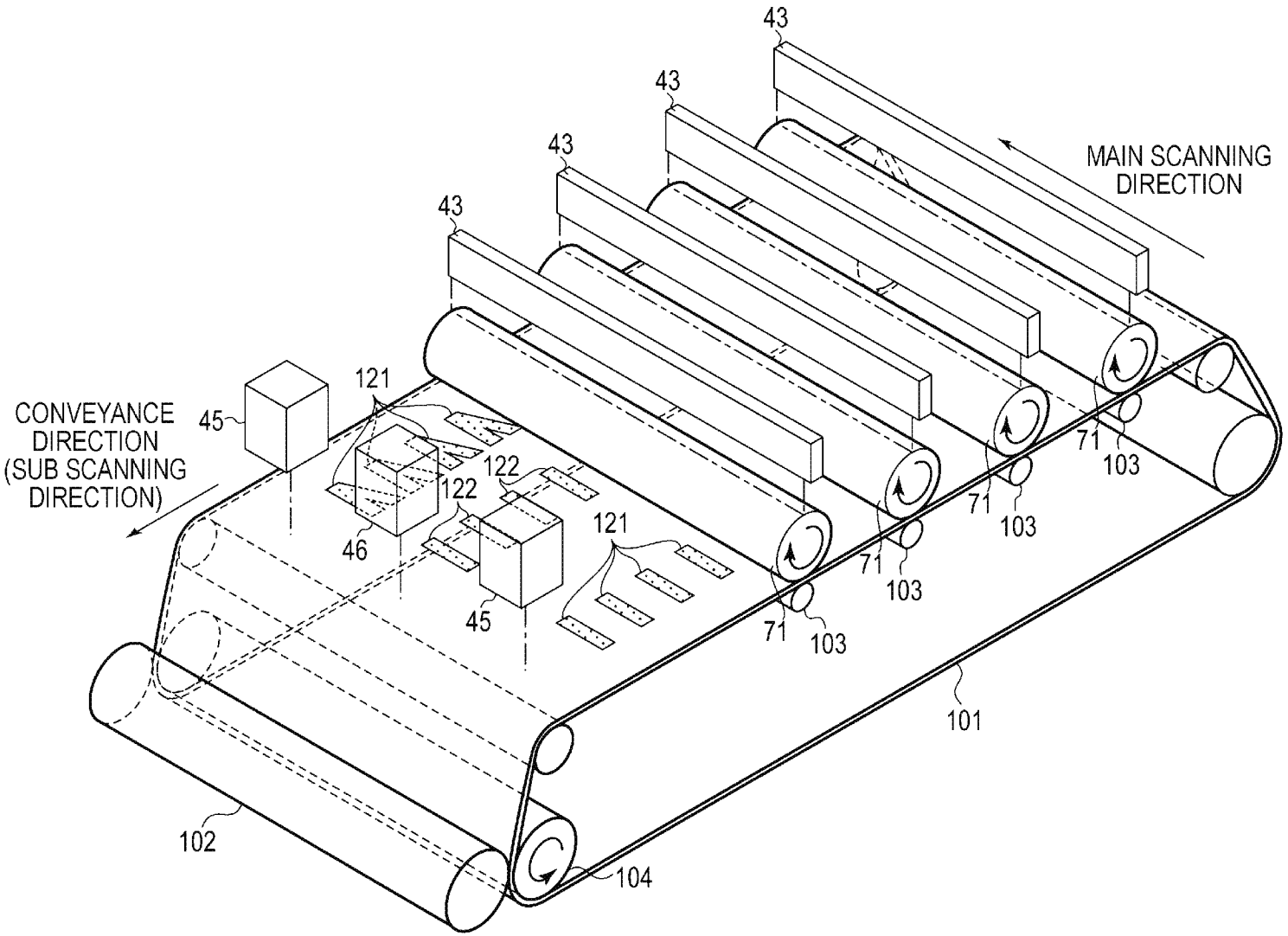
FIG. 3 is a perspective view of an example of a part of the image forming unit.

FIG. 3 is a perspective view of an example of a part of the image forming unit 19. Specifically, FIG. 3 is a perspective view of the transfer mechanism 44 of an image forming unit 19 when viewed from one of the light exposure devices 43 and the photosensitive drums 71. In the example of FIG. 3, the image forming unit 19 includes two first image sensors 45 and one second image sensor 46.

The first image sensors 45 detect the toner images transferred to the outer circumferential surface of the primary transfer belt 101. Reflected light from the outer circumferential surface of the primary transfer belt 101 by an illumination source (not shown) supplied to the first image sensors 45 by an optical system (not shown). The first image sensors 45 convert light into electric signals and supplies the electric signals corresponding to the light to the system controller 13. The two different first image sensors 45 are provided, for example, at one position close to the front of the image forming apparatus 1, and another position close to the rear of the image forming apparatus 1, respectively. The two first image sensors 45 detect the presence or absence of the toner image at a plurality of different positions in the main scanning direction.

A timing at which a toner image is detected by each of the first image sensors 45 varies according to the position at which the photosensitive drum 71 and the primary transfer belt 101 are in contact with each other, a position on the photosensitive drum 71 to which light is emitted by the light exposure device 43, or the like. That is, the system controller 13 may determine relative positional deviation, skew, or the like among the plurality of processing units 42, based on a detection timing of a detection voltage from the first image sensors 45.

The second image sensor 46 detects a density of a toner image transferred to the outer circumferential surface of the primary transfer belt 101. Reflected light from the outer circumferential surface of the primary transfer belt 101 by an illumination source (not shown) is supplied to the second image sensor 46 by an optical system (not shown). The second image sensor 46 converts light into an electric signal and supplies the electric signal to the system controller 13. The second image sensor 46 is provided, for example, between the two first image sensors 45.

A voltage detected by the second image sensor 46 varies according to a density of a toner image. That is, the second image sensor 46 supplies a voltage or other output corresponding to a density of a toner image. The system controller 13 may determine whether a density of a toner image on the outer circumferential surface of the primary transfer belt 101 is lower or higher than a target density based on the output of the second image sensor 46.

Hereinafter, a configuration related to fixing of the image forming apparatus 1 will be described.

The fixing device 20 fixes the toner image onto a printing medium P to which the toner image has been transferred. The fixing device 20 operates based on control of the system controller 13. The fixing device 20 includes a heating member applying heat to the printing medium P and a pressing member applying a pressure to the printing medium P. For example, the heating member is a heating roller 111. For example, the pressing member is a press roller 112.

The heating roller 111 is a rotary body which is rotated by a motor. The heating roller 111 includes a core formed of metal in a hollow shape and an elastic layer formed on the outer circumference of the core. The heating roller 111 is heated to a high temperature by a heater inside the hollow core. The heater is, for example, a halogen lamp heater. The heater may be an induction heating (IH) heater heating the core metal by electromagnetic induction.

The press roller 112 is provided at a position opposite to the heating roller 111. The press roller 112 includes a core formed of metal and having a predetermined outer diameter, and an elastic layer formed on the outer circumference of the core. The press roller 112 applies a pressure to the heating roller 111 according to a force applied by a tensioning member or spring element. A pressure is applied from the press roller 112 to the heating roller 111 such that a fixing nip where the press roller 112 and the heating roller 111 are in close proximity with each other is formed. The press roller 112 is rotated by a motor (not shown). The press roller 112 moves the printing medium P entering the fixing nip by rotating and, simultaneously, presses the printing medium P against the heating roller 111.

According to the above-described configuration, the heating roller 111 and the press roller 112 apply heat and pressure to the printing medium P passing through the fixing nip. Accordingly, the toner image is fixed to the printing medium P passing through the fixing nip. The printing medium P passing through the fixing nip is introduced to the paper discharge conveyance path 32 and is discharged to the outside of the housing 11.

Hereinafter, control of the image forming apparatus 1 by the system controller 13 will be described.

First, a toner supply from the sub tank 73 to the developing device 74 will be described.

The processor 21 controls the operation of the second toner supply motor 84 based on a detected voltage of the ATC sensor 95. For example, if the detected voltage of the ATC sensor 95 is less than a pre-set threshold value, the processor 21 determines that a concentration ratio of the toner in the developer container 91 of the developing device 74 is reduced. Therefore, if the detected voltage of the ATC sensor 95 is less than the pre-set threshold value, the processor 21 operates the second toner supply motor 84 to supply the toner from the toner container 81 of the sub tank 73 to the developer container 91 of the developing device 74. Accordingly, the processor 21 controls the operation of the second toner supply motor 84, such that the concentration ratio of the toner in the developer container 91 of the developing device 74 falls within a predetermined range.

Hereinafter, a toner supply from the toner cartridge 2 to the sub tank 73 will be described.

The processor 21 controls the operation of the first toner supply motor 51, based on a result of detection of the toner residue sensor 82. For example, if the result of detection of the toner residue sensor 82 switches from the ON state to the OFF state, the processor 21 operates the first toner supply motor 51 for a predetermined time (or for a predetermined quantity of driving). Accordingly, the processor 21 causes the toner to be supplied from the toner container 61 of the toner cartridge 2 to the toner container 81 of the sub tank 73.

Hereinafter, determination of a toner near empty condition will be described.

The processor 21 determines whether an amount of toner remaining in the toner container 61 is smaller than a predetermined amount (corresponding to a toner near empty state) based on the cumulative quantity of driving of the first toner supply motor 51. First, the processor 21 obtains a near empty threshold value from the IC chip 64 of the toner cartridge 2 via the communication interface 52. The processor 21 calculates an amount of supplied toner, which is an amount of toner that has been supplied from the toner cartridge 2 since mounting/installation. For example, the processor 21 adds up all the quantities of driving of the first toner supply motor 51 occurring since a toner cartridge 2 was last replaced. The processor 21 calculates the amount of supplied toner based on these added quantities of driving and an amount of supplied toner per each unit quantity of driving. The processor 21 compares the calculated amount of supplied toner to the near empty threshold value for the particular toner cartridge 2. If the calculated amount of supplied toner is greater than or equal to the near empty threshold value, the processor 21 determines that the toner cartridge is in the toner near empty state.

If it is determined that the toner cartridge 2 is in the toner near empty state, the processor 21 outputs a notification relating to the amount of remaining toner via the display unit 14 or the communication interface 12. For example, the processor 21 outputs a toner near empty display signal indicating that the amount of toner remaining in the toner cartridge 2 is low.

Hereinafter, an image quality stabilization process will be described.

In order to maintain image quality, the processor 21 forms a test pattern using a toner and causes the formed test pattern to be detected by the first image sensors 45 and the second image sensor 46. The processor 21 performs an image quality stabilization process of controlling various parameters in an image forming process based on the result of detection.

One of the parameters in the image forming process is, for example, a position where a toner image is formed (position alignment parameter), or a density of the toner image (density adjustment parameter). In this example, a process of adjusting the position alignment parameter is referred to as a position alignment process, and a process of adjusting the density adjustment parameter is referred to as a density adjustment process.

As shown in FIG. 3, the processor 21 controls the image forming unit 19 to form first test patterns 121 and second test patterns 122 on the primary transfer belt 101. The processor 21 performs the position alignment process based on a result of detecting the first test patterns 121 by the first image sensors 45. In addition, the processor 21 performs the density adjustment process based on a result of detecting the second test patterns 122 by the second image sensor 46.

First, the position alignment process will be described.

The position alignment parameter is a parameter for controlling a timing at which light is emitted to the photosensitive drum 71 by the light exposure device 43. The light exposure device 43 controls a timing of light emission of each light emitter of the light exposure device 43, based on the position alignment parameter. That is, the processor 21 may shift the position of the toner image formed on the primary transfer belt 101 in a sub scanning direction by adjusting the position alignment parameter in the position alignment process.

The first test pattern 121 is a toner image which is formed at a position where the toner image is detectable by the plurality of first image sensors 45 in the main scanning direction. That is, the first test patterns 121 are formed at a position close to the front of the image forming apparatus 1 and at a position close to the rear of the image forming apparatus 1, respectively. In addition, the first test patterns 121 may be formed from a position close to the front of the image forming apparatus 1 to a position close to the rear of the image forming apparatus 1.

Leading toner images of the first test patterns 121 in the sub scanning direction are formed at least at the same timing. That is, the leading toner images of the first test patterns 121 in the sub scanning direction are formed based on latent images (latent images of one line) formed on the photosensitive drums 71 by light emitted to the photosensitive drums 71 from the light exposure device 43.

The processor 21 forms the first test patterns 121 on the primary transfer belt 101 for each processing unit 42. For example, as shown in FIG. 3, the processor 21 forms the first test patterns 121 at predetermined intervals in the sub scanning direction for each processing unit 42. Relative positional deviation, skew, and the like among the plurality of processing units 42 are reflected on the first test patterns 121 formed as described above.

The processor 21 causes the plurality of first image sensors 45 to detect the first test patterns 121, respectively, and obtains the result of detection. The processor 21 calculates the relative positional deviation, skew, and the like among the plurality of processing units 42, based on a difference in timings at which the toner images are detected by the plurality of first image sensors 45. The processor 21 sets the position alignment parameter based on the result of calculating the relative positional deviation and the skew among the plurality of processing units 42. That is, the processor 21 sets the position alignment parameter such that the relative positional deviation, the skew and the like among the plurality of processing units 42 are reduced. Specifically, the processor 21 shifts the position of the toner image formed on the primary transfer belt 101 in the sub scanning direction for each processing unit 42 and each light emitter based on the result of detection by the plurality of first image sensors 45. Accordingly, the relative positional deviation, skew, and the like among the plurality of processing units 42 are reduced.

Hereinafter, the density adjustment process will be described.

The density adjustment parameter is a parameter for controlling an intensity of light (also referred to as a light exposure power) emitted to the photosensitive drums 71 by the light exposure devices 43, and/or a developing bias applied to the photosensitive drums 71 by the charger 72. The processing units 42 and/or the light exposure devices 43 form the toner images on the primary transfer belt 101, based on the density adjustment parameter. If the density adjustment parameter changes, the density of the formed toner image changes. That is, the processor 21 may control the density of the toner image formed on the primary transfer belt 101 by adjusting the density adjustment parameter in the density adjustment process.

The second test pattern 122 is a toner image that is formed on the primary transfer belt 101 based on a pre-set density adjustment parameter. The second test pattern 122 is formed at a position where the second test pattern is detectable by the second image sensor 46. Even if the density adjustment parameters are the same, the density of the toner image formed on the primary transfer belt 101 may change due to various factors such as temperature, humidity, or other changes. That is, the density of the toner image of the second test pattern 122 formed as described above may change due to various factors.

The processor 21 forms the second test patterns 122 on the primary transfer belt 101 for each processing unit 42. For example, as shown in FIG. 3, the processor 21 forms the second test patterns 122 at predetermined intervals in the sub scanning direction for each processing unit 42. The processor 21 causes the second image sensor 46 to detect each of the second test patterns 122, and obtains the result of detection.

An output of the second image sensor 46 changes according to the detected density of a toner image. The result of detection of the second test patterns 122 by the second image sensor 46 can be a voltage or other output corresponding to the density of the toner image of the second test patterns 122.

The processor 21 sets the density adjustment parameter based on the output from the second image sensor 46 and a pre-set reference value. That is, the processor 21 sets the density adjustment parameter based on the output obtained from the second image sensor 46 and the pre-set reference value, such that the density of the toner image of the second test patterns 122 approaches a target density. Specifically, the processor 21 controls light exposure power and/or a developing bias based on the output from the second image sensor 46 and the pre-set reference value. Accordingly, changes in the density of the toner image are reduced. In addition, the reference value may be a pre-set value or may be a value which is generated based on light detected from the primary transfer belt 101 on which a toner image is not formed.

Hereinafter, determination of whether the image quality stabilization process is to be performed will be described.

First Embodiment

Figure 4:
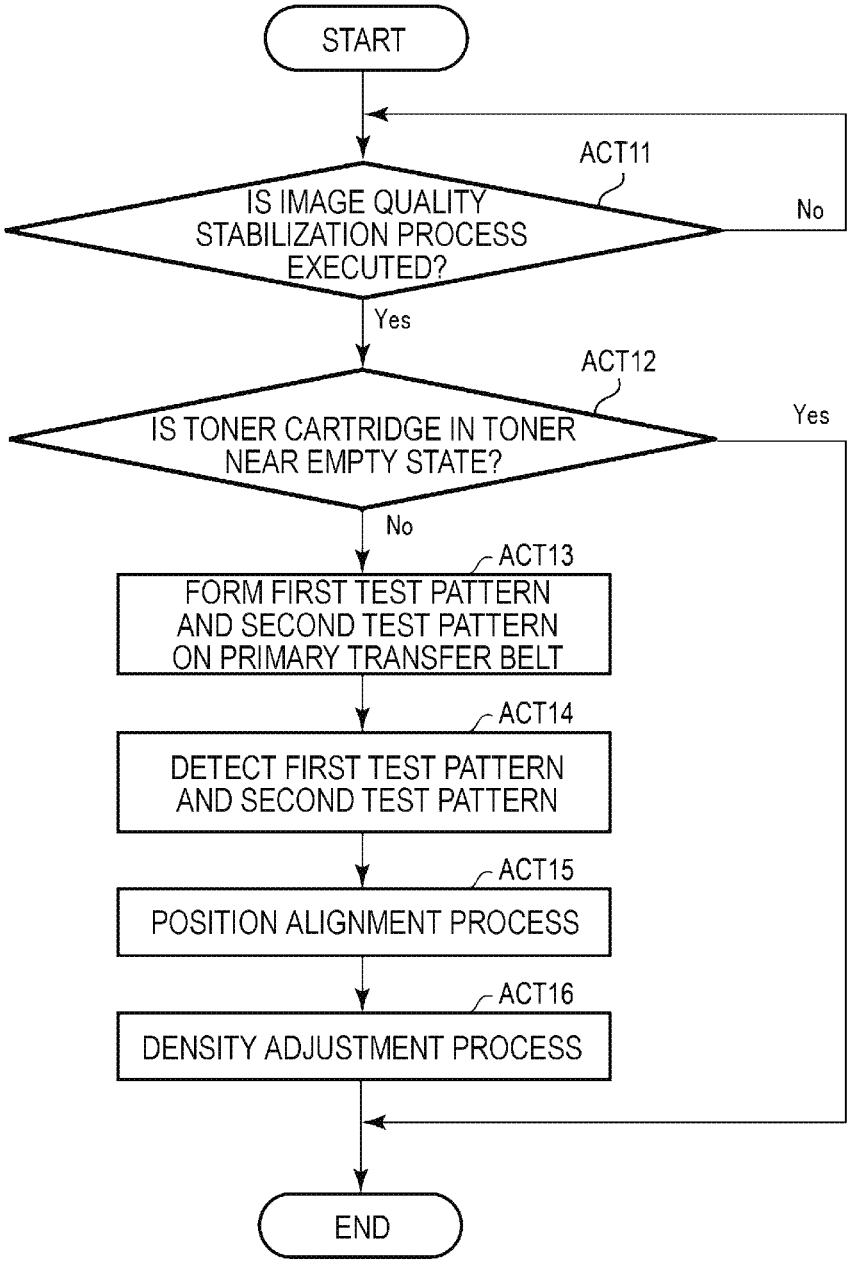
FIG. 4 is a flowchart illustrating an example of processes performed by the image forming apparatus.

FIG. 4 is a flowchart illustrating processes of the image forming apparatus 1 according to a first embodiment.

The image forming apparatus 1 executes the image quality stabilization process based on a predetermined condition. For example, the processor 21 of the system controller 13 of the image forming apparatus 1 determines whether to execute the image quality stabilization process, based on a state of the image forming apparatus 1 and a pre-set condition (ACT 11). For example, if power of the image forming apparatus 1 is turned on, if the number of passing paper sheets (the number of printed sheets) reaches a predetermined number of sheets, or if color printing is performed, the processor 21 determines that the image quality stabilization process is performed.

If it is determined that the image quality stabilization process is executed (ACT 11, YES), the processor 21 determines whether the toner cartridge is in a toner near empty state (ACT 12). The processor 21 determines whether the amount of toner in the toner cartridge 2 is low (toner near empty state), based on the cumulative amount of driving of the first toner supply motor 51 and a near empty threshold value obtained from the toner cartridge 2 as described above.

When it is determined that the toner cartridge is not in the toner near empty state (ACT 12, NO), the processor 21 controls the image forming unit 19 to form the first test patterns 121 and the second test patterns 122 on the primary transfer belt 101 (ACT 13). That is, the processor 21 operates to form the first test patterns 121 on the primary transfer belt 101 for each processing unit 42 based on a predetermined position alignment parameter and forms the second test patterns 122 on the primary transfer belt 101 for each processing unit 42 based on a predetermined density adjustment parameter.

The processor 21 controls the first image sensors 45 and the second image sensor 46 to detect the first test patterns 121 and the second test patterns 122 formed on the primary transfer belt 101, respectively (ACT 14). That is, the processor 21 causes the first test patterns 121 to be detected by at least two first image sensors 45, and causes the second test patterns 122 to be detected by the second image sensor 46.

The processor 21 performs a position alignment process, which is one of the image quality stabilization processes, based on the detected first test patterns 121 by the two or more first image sensors 45 (ACT 15). That is, the processor 21 sets the position alignment parameter based on a difference in timings at which the first test patterns 121 are detected by the two or more first image sensors 45, such that relative positional deviation, skew, and the like among the plurality of processing units 42 are reduced. More specifically, the processor 21 sets the position alignment parameter for each processing unit 42 and each light emitter, based on a difference in timings at which the first test patterns 121 are detected by the two or more first image sensors 45.

In addition, the processor 21 performs a density adjustment process, which is one of the image quality stabilization processes, on the second test patterns 122 based on a voltage value obtained from the second image sensor 46 and a pre-set reference value (ACT 16). That is, the processor 21 sets the density adjustment parameter based on the voltage value obtained from the second image sensor 46 and the pre-set reference value, such that the density of the toner image of the second test patterns 122 approaches a target density, and finishes the processes of FIG. 4.

If it is determined that the toner cartridge is in the toner near empty state at ACT 12 (ACT 12, YES), the processor 21 finishes the processes of FIG. 4 without the first test patterns 121 and the second test patterns 122 being formed, and without performing the position alignment process and the density adjustment process.

As described above, the image forming apparatus 1 includes: the photosensitive drum 71; the electrostatic charger 72 for charging the photosensitive drum 71; the light exposure device 43 for forming a latent image on the photosensitive drum 71; the developing device 74 for attaching a toner supplied from the toner cartridge 2 to the latent image to form a toner image on the photosensitive drum 71; the transfer mechanism 44 for receiving the toner image from the photosensitive drum 71 and transferring the toner image to the printing medium P; at least one image sensor (e.g., a first image sensor 45 and/or a second image sensor 46) for detecting the toner image on the transfer mechanism 44; and the processor 21. The processor 21 changes whether the image quality stabilization process is performed for adjusting a toner image forming parameter based on whether a toner cartridge 2 is in the toner near empty state. Furthermore, if a toner cartridge 2 is not in the toner near empty state, the processor 21 performs the image quality stabilization process as indicated by detection results from one or more sensors, but when a toner cartridge 2 is in the toner near empty state, the processor 21 does not perform the image quality stabilization process. Accordingly, it is possible to prevent extend the time to empty for the toner cartridge 2 after the toner cartridge enters the toner near empty state.

When the toner cartridge is not in a toner near empty state, the processor 21 performs the position alignment process of controlling a timing at which light is emitted to the photosensitive drum 71 by the light exposure device 43 as normal based on a timing at which the toner image of the first test patterns 121 is detected by the first image sensors 45, but when the toner cartridge is in the toner near empty state, the processor 21 does not perform the position alignment process. Accordingly, it is possible to prevent the time until the toner cartridge 2 is empty from being shortened.

In addition, if the toner cartridge is not in the toner near empty state, the processor 21 performs the density adjustment process of controlling an intensity of charging of the photosensitive drum 71 by the charger 72, or an intensity of light emitted to the photosensitive drum 71 by the light exposure device 43, based on a density of the toner image as detected by the second image sensor 46, but when the toner cartridge is in the toner near empty state, the processor 21 does not perform the density adjustment process. Accordingly, it is possible to prevent the time until the toner cartridge 2 is empty from being shortened.

In addition, if the toner cartridge is not in the toner near empty state, the processor 21 may perform both the density adjustment process and the position alignment process, but if the toner cartridge is in the toner near empty state, the processor 21 does not perform either of the density adjustment process and the position alignment process.

Second Embodiment

Figure 5:
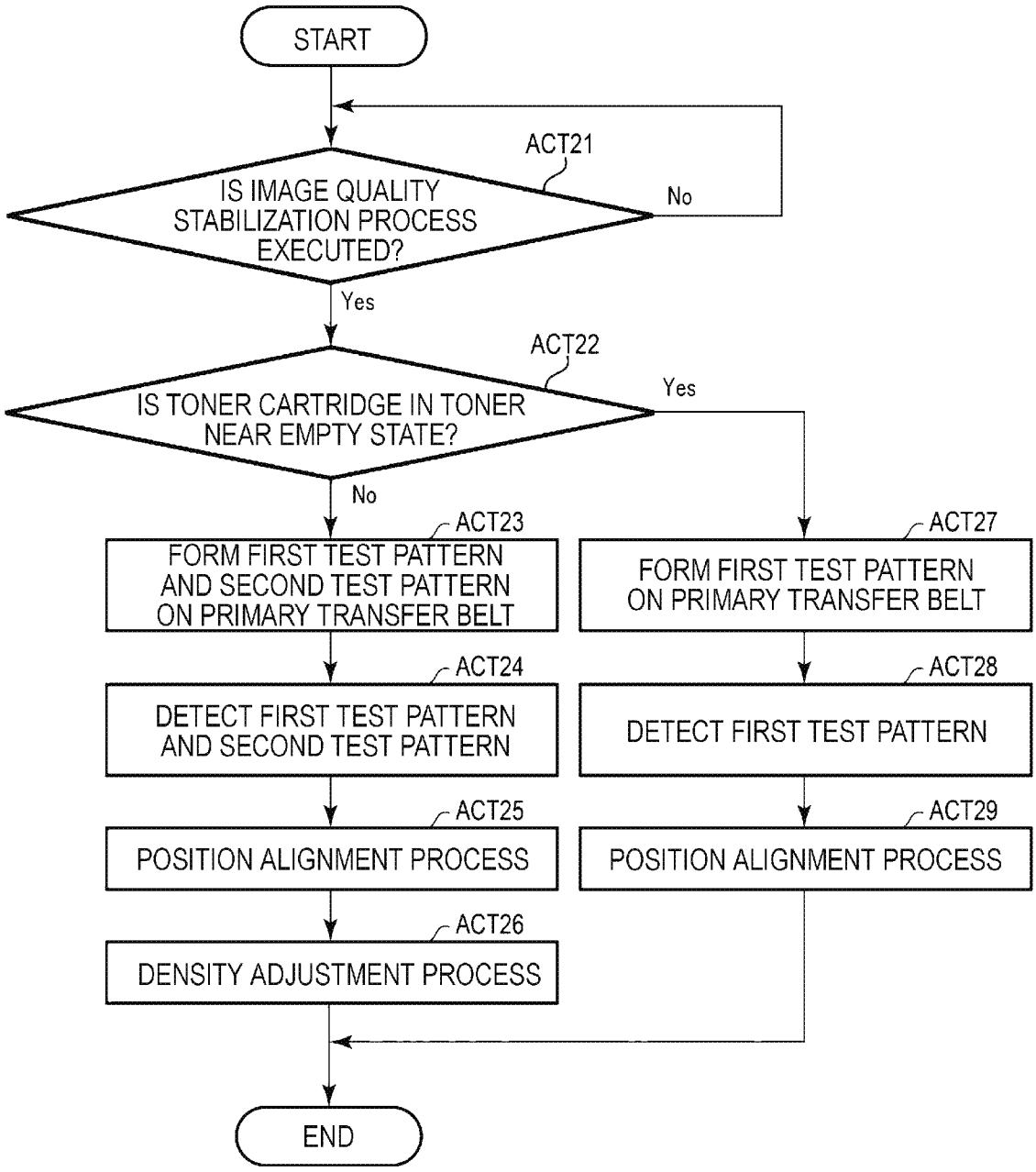
FIG. 5 is a flowchart illustrating an example of processed performed by an image forming apparatus according to a second embodiment.

FIG. 5 is a flowchart illustrating processes of the image forming apparatus 1 according to a second embodiment. In the first embodiment, if the toner cartridge is not in the toner near empty state, both the density adjustment process and the position alignment process are performed, but if the toner cartridge is in the toner near empty state, the density adjustment process and the position alignment process are not performed. In contrast, in the second embodiment, if the toner cartridge is not in the toner near empty state, both the density adjustment process and the position alignment process are performed; however, if the toner cartridge is in the toner near empty state, the position alignment process is still performed but the density adjustment process is not performed.

The image forming apparatus 1 executes the image quality stabilization process based on a predetermined condition. For example, the processor 21 of the system controller 13 of the image forming apparatus 1 determines whether to execute the image quality stabilization process based on a state of the image forming apparatus 1 and a pre-set condition (ACT 21).

If it is determined that the image quality stabilization process is to be performed (ACT 21, YES), the processor 21 determines whether the toner cartridge is in a toner near empty state (ACT 22).

If it is determined that the toner cartridge is not in the toner near empty state (ACT 22, NO), the processor 21 controls the image forming unit 19 to form the first test patterns 121 and the second test patterns 122 on the primary transfer belt 101 (ACT 23).

The processor 21 controls the first image sensors 45 and the second image sensor 46 to detect the first test patterns 121 and the second test patterns 122 formed on the primary transfer belt 101, respectively (ACT 24).

The processor 21 performs the position alignment process based on the result of detecting the first test patterns 121 by the two or more first image sensors 45 (ACT 25).

In addition, the processor 21 performs the density adjustment process on the second test patterns 122 based on a voltage value obtained from the second image sensor 46 and a pre-set reference value (ACT 26), and finishes the processes of FIG. 5.

If it is determined that the toner cartridge is in the toner near empty state (ACT 22, YES), the processor 21 controls the image forming unit 19 to form the first test patterns 121 on the primary transfer belt 101 (ACT 27).

The processor 21 controls the first image sensors 45 to detect the first test patterns 121 formed on the primary transfer belt 101 (ACT 28).

The processor 21 performs the position alignment process based on the result of detecting the first test patterns 121 by the two or more first image sensors 45 (ACT 29), and finishes the processes of FIG. 5. That is, the processor 21 finishes the image quality stabilization process without performing a density adjustment process.

As described above, if the toner cartridge 2 is not in the toner near empty state, the processor 21 performs both the position alignment process and the density adjustment process as the image quality stabilization process. If the toner cartridge 2 is in the toner near empty state, the processor 21 performs the position alignment process but does not perform the density adjustment process. According to the image forming apparatus 1 of the second embodiment as described above, even when the toner cartridge is in the toner near empty state, image quality can be maintained with the position alignment process, and the toner can be prevented from being consumed by omitting the density adjustment process. As a result, maintenance of image quality and suppression of toner consumption can be realized.

In the above-described embodiments, a process to be executed as the image quality stabilization process is changed based on whether a toner cartridge is in a near empty state, but embodiments are not limited to this. A frequency of executing an image quality stabilization process may be change based on whether or not the toner cartridge 2 is in the toner near empty state. For example, if the toner cartridge 2 is in the toner near empty state, the processor 21 may execute the image quality stabilization process less frequently than if the toner cartridge is not in the toner near empty state. Thus, toner consumption can be suppressed when the toner cartridge is in the toner near empty state. Specifically, if the toner cartridge is in the toner near empty state, the processor 21 may set a number of passing sheets, as a condition for determining whether to execute the image quality stabilization process, to be larger than that if the toner cartridge is not in the toner near empty state, such that the frequency of executing the image quality stabilization process after the toner cartridge goes into the toner near empty state can be reduced.

In addition, the functions described in each of the above-described embodiments are not limited to being provided using hardware, and in some examples a software program having each function recorded therein may be read and implemented on a computer by using software. In addition, each function may be provided by appropriate combinations of software and hardware.

While certain embodiments have been described, these embodiments have been presented by way of example only, and are not intended to limit the scope of invention. Indeed, the novel apparatus and methods described herein may be embodied in a variety of other forms; furthermore, various omissions, substitutions and changes in the form of the apparatus and methods described herein may be made without departing from the spirit of the inventions. The accompanying claims and their equivalents are intended to cover such forms or modifications as would fall within the scope and spirit of the inventions.

What is claimed is:

1. An image forming apparatus, comprising:

a photosensitive drum;

a developing device configured to supply toner from a toner cartridge to a surface of the photosensitive drum to form a toner image;

a transfer unit configured to receive the toner image from the photosensitive drum;

an image sensor configured to detect the toner image on the transfer unit; and a processor configured to:

determine whether a remaining amount of toner in the toner cartridge is at or below a predetermined level;

when the remaining amount is above the predetermined level, perform a first image quality stabilization process based on a first detection result from the image sensor detecting a first test toner pattern formed on the transfer unit, and when the remaining amount is at or below the predetermined level, perform a second image quality stabilization process based on a second detection result from the image sensor detecting a second test toner pattern formed on the transfer unit, the second test toner pattern being formed with a lesser amount of toner than the first test toner pattern.

2. The image forming apparatus according to claim 1, wherein the processor is configured to determine the remaining amount of toner in the toner cartridge based on a cumulative amount a motor for supplying toner out of the toner cartridge has been driven.

3. The image forming apparatus according to claim 1, wherein the first image quality stabilization process includes correcting an alignment parameter and a toner density parameter according to the first detection result, and the second image quality stabilization process includes correcting one of the alignment parameter or the toner density parameter according to the second detection result.

4. The image forming apparatus according to claim 3, wherein the second image quality stabilization process includes correcting the alignment parameter according to the second detection result.

5. The image forming apparatus according to claim 1, wherein the image sensor includes a first image sensor at a first position in a main scanning direction and a second image sensor at a second position in the main scanning direction, the first test toner pattern includes a first sub pattern positioned to be detected by the first image sensor and a second sub pattern positioned to be detected by the second image sensor, and the second test toner image pattern includes the first sub pattern but not the second sub pattern.

6. The image forming apparatus according to claim 5, wherein the image sensor further includes a third image sensor between the first and second image sensor in the main scanning direction.

7. The image forming apparatus according to claim 5, wherein the first detection result includes a detection timing of the first sub pattern as detected by the first image sensor, and a toner density of the second sub pattern as detected by the second image sensor.

8. An image forming apparatus, comprising:

a photosensitive drum;

a developing device configured to supply toner from a toner cartridge to a surface of the photosensitive drum to form a toner image;

a transfer unit configured to receive the toner image from the photosensitive drum;

an image sensor configured to detect the toner image on the transfer unit; and a processor configured to:

determine whether a remaining amount of toner in the toner cartridge is at or below a predetermined level, when the remaining amount is above the predetermined level, perform an image quality stabilization process at first frequency, the image quality stabilization process being based on a detection result from the image sensor detecting a toner test pattern on the transfer unit, and when the remaining amount of toner is at or below to the predetermined level, perform the image quality stabilization process at a second frequency less than the first frequency.

9. The image forming apparatus according to claim 8, wherein the processor is configured to determine the remaining amount of toner in the toner cartridge based on a cumulative amount a motor for supplying toner out of the toner cartridge has been driven.

10. The image forming apparatus according to claim 8, wherein the image quality stabilization process includes adjusting at least one of an alignment parameter and a toner density parameter according to the detection result.

11. The image forming apparatus according to claim 8, wherein the transfer unit is an intermediate transfer belt.

12. The image forming apparatus according to claim 10, wherein adjusting the toner density parameter includes adjusting at least one of an exposure source intensity or a developing bias voltage applied to the photosensitive drum.

13. The image forming apparatus according to claim 10, wherein adjusting the alignment parameter includes adjusting an exposure timing for forming the latent image on the photosensitive drum.

14. The image forming apparatus according to claim 8, wherein the image sensor includes a first image sensor at a first position along a main scanning direction and a second image sensor at a second position along the main scanning direction, the toner test pattern includes a first sub pattern positioned to be detected by the first image sensor and a second sub pattern positioned to be detected by the second image sensor, and the detection result includes a detection timing of the first sub pattern as detected by the first image sensor, and a toner density of the second sub pattern as detected by the second image sensor.

* * * * *